United States Patent [19]

Anderson

[11] Patent Number: 4,693,174

[45] Date of Patent: Sep. 15, 1987

[54] AIR DEFLECTING MEANS FOR USE WITH AIR OUTLETS DEFINED IN DROPPED CEILING CONSTRUCTIONS

[76] Inventor: Philip K. Anderson, 72 Franklin Corner Rd., Lawrenceville, N.J. 08648

[21] Appl. No.: 861,385

[22] Filed: May 9, 1986

[51] Int. Cl.[4] ..... F24F 13/06

[52] U.S. Cl. ..... 98/40.05; 98/40.1; 98/40.15

[58] Field of Search ..... 98/40.05, 40.1, 40.14, 98/40.15, 40.16

[56] References Cited

U.S. PATENT DOCUMENTS

| | | | |
|---|---|---|---|
| 716,450 | 12/1902 | Maloney . | |
| 1,488,694 | 4/1924 | Marks . | |
| 1,517,179 | 11/1924 | Thurgood . | |
| 2,212,468 | 8/1940 | Ferris | 98/40.05 X |
| 2,230,203 | 1/1941 | Mack et al. . | |
| 2,369,119 | 2/1945 | Dauphinee . | |
| 2,558,421 | 6/1951 | Daninhirsch . | |
| 2,858,760 | 11/1958 | Lathrop | 98/40.15 |
| 3,225,679 | 12/1965 | Meyer | 98/103 |
| 3,768,235 | 10/1973 | Meyer et al. | 98/108 X |
| 3,906,846 | 9/1975 | Day | 98/40.1 |
| 3,908,528 | 9/1975 | Bertin et al. | 98/108 |
| 4,060,025 | 11/1977 | Pelosi, Jr. | 98/40.1 X |
| 4,182,227 | 1/1980 | Roy | 98/40.15 |

FOREIGN PATENT DOCUMENTS

| | | | |
|---|---|---|---|
| 716977 | 10/1931 | France | 98/40.15 |

*Primary Examiner*—Harold Joyce

*Attorney, Agent, or Firm*—Sperry, Zoda & Kane

[57] ABSTRACT

An air deflector is disclosed with adjustable brackets for suspending the deflecting shield at variable distances from an air vent positioned within a dropped ceiling. The suspension brackets include a hook for resilient flexible securement with respect to the inverted T-shaped support members of the dropped ceiling as well as a rod having a number of cross members positioned thereon extendable through slots defined in the air deflector for maintaining that deflector at variable distances from the vent defined in the dropped ceiling thereabove. A vane member is included which may be engageable with respect to another similarly configured vane member such as to be angularly oriented with respect to the upper surface of the deflecting shield to guide air outwardly therefrom away from wall or corner areas as desired. For this purpose grooves may be defined in the upper surface of the deflecting shield.

22 Claims, 7 Drawing Figures

AIR DEFLECTING MEANS FOR USE WITH AIR OUTLETS DEFINED IN DROPPED CEILING CONSTRUCTIONS

BACKGROUND OF THE INVENTION

1. Field Of The Invention

The present invention deals with the field of devices for deflecting air as it is emitted from air outlets. These devices are normally used with air conditioning or heating vents which distribute hot or cold air for controlling air temperature within a building.

Under normal circumstances especially when cold air is distributed through air outlets or air vents in a ceiling, the laminar flow of air causes drafts upon individuals which may be seated adjacent to or below these air vents. The present invention pertains to the field of devices for dispersing the air more evenly throughout the room relatively quickly and by preventing drafts caused by this emitted air.

2. Description Of The Prior Art

Various devices have been designed for deflecting of heating or cooling air when emitted from vents such as U.S. Pat. No. 716,450 patented Dec. 23, 1902 to D. J. Maloney for a Deflector and; U.S. Pat. No. 1,488,694 to L. Marks patented Apr. 1, 1924 on a Dust Collector For Hot Air Registers Or Radiators; U.S. Pat. No. 1,517,179 patented Nov. 25, 1924 to E. Thurgood on a Combined Hot Air Deflector And Foot Rest; U.S. Pat. No. 2,230,203 patented Jan. 28, 1941 to L. Mack et al on an Air Distributing Apparatus; U.S. Pat. No. 2,369,119 patented Feb. 13, 1945 to G. S. Dauphinee on a Ventilating System; U.S. Pat. No. 2,558,421 patented Jun. 26, 1951 to H. Daninhirsch on a Diffuser With A Detachable Deflector Member; U.S. Pat. No. 2,858,760 patented Nov. 4, 1958 to H.F. Lathrop on a Diffuser; U.S. Pat. No. 3,225,679 patented Dec. 28, 1965 to C.P. Meyer on an Air Deflector; U.S. Pat. No. 3,768,235 patented Oct. 30, 1973 on an Air Filter And Deflector With Enclosed Magnet Mounts; U.S. Pat. No. 3,770,047 patented Nov. 6, 1973 to M. Kirkpatrick et al on an Apparatus For Unidirectionally Solidifying Metals; U.S. Pat. No. 3,906,846 patented Sept. 23, 1975 to C. Day on a Dirt Control Shield For An Air Outlet; U.S. Pat. No. 3,908,528 patented Sept. 30, 1975 to M. Bertin et al on Diffusers For Conditioned Air; and U.S. Pat. No. 4,182,227 patented Jan. 8, 1980 to M. Roy on a Ventilation Diffuser.

No such devices as described above and others do not include the adjustable or novel suspension aspects shown and claimed in the present invention. These advantages will be more readily understood when the Detailed Description Of The Preferred Embodiment disclosed herein is reviewed below.

SUMMARY OF THE INVENTION

The present invention provides an air deflector means being particularly usable with air outlets defined in dropped ceiling constructions. All such dropped ceiling constructions include a framework of inverted T-shaped support members with the ceiling panels supported and suspended therebetween.

The deflection apparatus of the present invention includes a suspension bracket having a hook means at the upper end thereof which is selectively securable with respect to the inverted T-shaped support members of the dropped ceiling. Preferably this suspension bracket will be of a resilient material such as plastic to facilitate bending or flexing for initial securement with respect to the T-shaped support members.

The suspension bracket means further includes a rod means at the lower end of each of the suspension brackets which extends downwardly with respect to the hook at the upper end thereof. A plurality of cross members are positioned extending laterally in spaced relation with respect to one another along the rod. Preferably these cross members are spaced from one another at approximately 9/16" or approximately 1/16" greater than the thickness of the deflecting shield which will be mounted therebetween.

The deflecting shield means itself is secured with respect to the suspension bracket means and extends horizontally therebetween and is spaced downwardly from the ceiling panel and air outlets thereabove. In this manner air being emitted through the air outlets and striking the upper surface of the deflecting shield is deflected outwardly for dispersal preventing drafts and insuring mixing of the conditioned air with respect to the remaining room environment. The deflecting sheild means preferably includes a plurality of slot means therein adapted to receive the rod means and the cross members extended therethrough. The means for deflecting air further include the plurality of cover caps which are positionable extending over the lower portions of the rod means and the lower individual cross member means which extend below the deflecting shield means to provide an aesthetically pleasing look for the ceiling fixture of the present invention.

The present invention may include one or more vane members which will facilitate the deflecting of air when the present invention is utilized adjacent to wall or corner areas. In this configuration the deflecting shield will define a plurality of grooves in the upper surface thereof which are adapted to receive the vanes extending therein for securement with respect to the upper deflecting area itself.

The vane means may be interlocked with respect to one another by the definition slits at various angles therein to facilitate the urging of fluid flow of air other than evenly downwardly over the four sides of the deflecting shield. When the present invention is utilized adjacent to a wall, it may be desirable to have most of the conditioned air fall over the edges of the deflecting shield which are not adjacent to the wall. This is true because the wall tends to confine the air falling off the edge of the deflecting shield thereadjacent to create a draft which is exactly what the present invention is designed to alleviate. When utilized adjacent to corners, there are two adjacent walls and therefore two adjacent shield edges must be somewhat shielded from allowing conditioned air to flow thereover and therefore two interlocking vane members angularly oriented with respect to the upper surface of a deflecting member would achieve this purpose. Preferably the vanes can be oriented with respect to the upper surface of the deflecting shield at approximately an angle of 60°. This angle can be determined by the angle of the slits in the vanes themselves or can be determined by the angular orientation of the groove defined in the upper surface of the shield.

Preferably in the present invention the deflecting shield means can be approximately square or rectangular in shape. Also it is preferable that the air deflecting means is of material similar to the ceiling panels. Normally such panels are ½" in thickness which cooperates well with the preferred 9/16" distance for the intervening spaces defined between adjacent cross members.

The cover cap means in order to aid in providing an aesthetically pleasing external appearance will preferably be shaped hemispherically. Also it is preferable that the cover cap means will be made of a material somewhat denser than the material of the deflecting shield itself.

In the preferred configuration the air deflecting means will include four individual suspension brackets each fixedly secured at their upper end to an adjacent portion of the T-shaped dropped ceiling suspension framework.

Also the deflecting shield will preferably define four individual slot members oriented perpendicularly with respect to the cross member means. That is, as each bracket is extending downwardly from the inverted T-shaped framework the cross members of the rod sections thereof will be oriented perpendicularly with respect to each of the four slots defined in the deflecting shield means. Since the brackets themselves are of a flexibly resilient material which may be plastic they can be initially deformed slightly to allow the rod means and some of the individual cross members to extend through the slot means and then can be released such that they will resiliently spring back to the original shape and thereby lock the deflecting shield in place.

Once the deflecting shield is locked in place in the above manner the excess portion of the rod means and the excess cross members extending below the deflecting shield can be removed. For this purpose a plurality of frangible sections can be positioned immediately below each laterally extending cross member to facilitate removal of the excess portion of the rod. In this manner only a single cross member will remain below the deflecting shield to allow the hemispherical cover plate means to be positioned thereon to provide an overall final aesthetically pleasing configuration. During installation, of course, any of the cross members can be chosen as the final cross member thereby allowing the adjustable aspect wherein the installer will have the capability of positioning the deflecting shield at any one of several pre-chosen distances from the air vent positioned thereabove so that the downward air flow will strike the deflecting shield in such a manner as to give the optimum of air dispersal and air current pattern to the area served by this air shield.

Preferably the hook at the upper end of the bracket will include a loop member which includes a cut section in the lower portion thereof. The inverted T-shaped support member can be positioned extending through the cut of the loop member to thereby detachably secure the loop member and the hook means to the inverted T-shaped framework merely by slightly deforming the resilient hook means. In this manner a detachable securement of the loop member with respect to the inverted T-shaped support framework is easily achieved.

It is an object of the present invention to define an air deflecting means for use with air outlets defined in dropped ceiling constructions wherein air emitted from an outlet above the air deflecting means is dispersed evenly throughout the room in which the air is being conditioned.

It is an object of the present invention to define an air deflecting means for use with air outlets defined in dropped ceiling constructions wherein minimal capital expense is required to prevent cold air drafts within an air conditioned room.

It is an object of the present invention to define an air deflecting means for use with air outlets defined in dropped ceiling constructions wherein air is dispersed throughout the conditioned room by a structure which has minimal maintenance requirements.

It is an object of the present invention to define an air deflecting means for use with air outlets defined in dropped ceiling constructions wherein an aesthetically pleasing configuration is positioned adjacent to the dropped ceiling.

It is an object of the present invention to define an air deflecting means for use with air outlets defined in dropped ceiling constructions wherein the distance between the air deflecting means and the dropped ceiling can be varied at the point of installation to provide an effective and aesthetically pleasing overall configuration.

It is an object of the present inventon to define an air deflecting means for use with air outlets defined in dropped ceiling constructions wherein there is a minimum need for tools for installation thereof.

It is an object of the present invention to define an air deflecting means for use with air outlets defined in dropped ceiling constructions wherein the deflecting structure blends in aesthetically with the ceiling configuration due to the use of similar material for deflecting as is used for the ceiling construction.

It is an object of the present invention to define an air deflecting means for use with air outlets defined in dropped ceiling constructions wherein installation is made relatively easy for two people working simultaneously.

It is an object of the present invention to define an air deflecting means for use with air outlets defined in dropped ceiling constructions wherein brackets are used for suspending the deflecting means from the ceiling at a pre-chosen distance which are flexible in order to greatly facilitate installation.

It is an object of the present invention to define an air deflecting means for use with air outlets defined in dropped ceiling constructions which is particularly usable adjacent to wall areas.

It is an object of the present invention to define an air deflecting means for use with air outlets defined in dropped ceiling constructions which prevents downward drafts adjacent to wall areas.

It is an object of the present invention to define an air deflecting means for use with air outlets defined in dropped ceiling constructions which is particularly usable adjacent to corner areas to prevent downward drafts in the environment thereadjacent.

It is an object of the present invention to define an air deflecting means for use with air outlets defined in dropped ceiling constructions wherein driven gaseous currents resulting from a forced air system are changed in direction such that their force is lessened at the point of use.

It is an object of the present invention to define an air deflecting means for use with air outlets defined in dropped ceiling constructions wherein the necessity of using an air directing vent or an air dispersal vent at the exit point of the air outlet from the ceiling tile is alleviated.

It is an object of the present invention to define an air deflecting means for use with air outlets defined in dropped ceiling constructions wherein the necessity for closing air vents causing drafts which are immediately adjacent to workers within an office building is alleviated.

It is an object of the present invention to define an air deflecting means for use with air outlets defined in dropped ceiling constructions wherein the basic design within an office building for air flow during forced air conditioning or heating is maintained while at the same time preventing excessive drafts.

It is an object of the present invention to provide a means for deflecting air after it has left an air diffuser or air duct opening such that the straight and downward air flow will become a generally horizontal air flow.

It is an object of the present invention to define an air deflecting means for use with air outlets defined in dropped ceiling constructions wherein after leaving the air diffuser or duct opening, the air flow speed will be decreased and air flow concentration will be dispersed responsive to striking the upper surface of the air deflector shield.

It is an object of the present invention to define an air deflecting means for use with air outlets defined in dropped ceiling constructions wherein drafts are eliminated from occupants of the immediate area.

It is an object of the present invention to define an air deflecting means for use with air outlets defined in dropped ceiling constructions wherein an air system can supply a higher volume of air as desired without incurring adverse effects such as excessive air turbulence in the area.

It is an object of the present invention to define an air deflecting means for use with air outlets defined in dropped ceiling constructions wherein initial cost is minimized.

It is an object of the present invention to define an air deflecting means for use with air outlets defined in dropped ceiling constructions wherein no moving parts are utilized.

It is an object of the present invention to define an air deflecting means for use with air outlets defined in dropped ceiling constructions wherein maintenance is not required.

It is an object of the present invention to define an air deflecting means for use with air outlets defined in dropped ceiling constructions wherein a pleasing overall external appearance and function is provided.

It is an object of the present invention to define an air deflecting means for use with air outlets defined in dropped ceiling constructions wherein a very simplistic design achieves the end result utilizing two basic parts plus one auxiliary part plus one cosmetic part.

It is an object of the present invention to define an air deflecting means for use with air outlets defined in dropped ceiling constructions wherein ease of assembly and disassembly is enhanced.

It is an object of the present invention to define an air deflecting means for use with air outlets defined in dropped ceiling constructions wherein a novel means of twisting and releasing the resilient connecting member facilitates locking and unlocking of the structure at the upper end to the ceiling framework.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
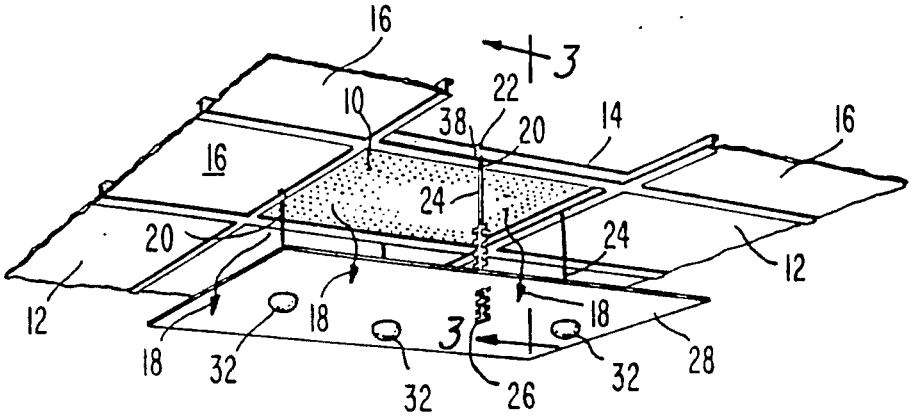
FIG. 1 is a perspective view of an embodiment of the air deflecting means of the present invention.

The present invention provides an air deflecting means for use with air outlets 10 defined within dropped ceiling constructions 12. Such ceiling constructions normally include inverted T-shaped support members 14 which define ceiling panels 16 extending therebetween. Air 18 exits from outlet 10 and normally when this air is cooled creates excessive cooling drafts within the environment of the room.

To overcome this problem a deflecting shield means 28 is suspended extending horizontally across the path of movement of this emitted air 18. Deflecting shield means 28 is secured with respect to the suspension bracket means 20. Each bracket means 20 includes a hook means 22 at the uppermost end thereof which is secured to the inverted T-shaped support member 14. A rod means 24 extends downwardly from the hook means 22 and includes a plurality of cross member means 26 located therealong.

Deflecting shield means 28 preferably defines a plurality of slot means 30 therein which are adapted to receive rod means 24 and cross member means 26 extending therethrough. In the chosen orientation cross member means 26 will be perpendicularly oriented with respect to slot means 30 to thereby prevent slipping of the cross member means 26 vertically through the slot means 30 after installation.

Preferably the suspension brackets 20 will be of resilient material to facilitate temporary flexing thereof to allow securement of the hook means 22 with respect to the inverted T-shaped support members 14 while at the same time allowing insertion of the rod means 24 and cross member means 26 through the slot means 30 temporarily. After the cross member means 26 is released they will snap back to the original orientation which is perpendicular with respect to slot means 30 thereby preventing slipping of the suspension bracket 20 through the slot means 30.

In a preferred configuration a frangible section 42 will be positioned immediately below each cross member means 26 to facilitate breaking of the cross member therealong. Once the deflecting shield means 28 is in place one of the cross member means 26 will be positioned immediately below the shield means 28. All of the remaining cross member means 28 other than the one in abutment with the bottom surface of the deflecting shield 28 will no longer be needed and therefore cutting or breaking of the rod means 24 immediately below the last cross member means 26 is advantageous in order to provide an overall aesthetically pleasing design. This cutting or breaking along the frangible section 42 can be achieved by a cutter or by deforming the rod means 24 back and forth to fatigue the resilient material for breaking thereof.

To further provide an aesthetically pleasing overall appearance a hemispherical cover cap means 32 may be included of a somewhat dense material such that it can be pushed upwardly and will slightly deform and thereby will adhere to the remaining cross member means 26 extending laterally below the lower surface of deflecting shield means 28.

Figure 2:
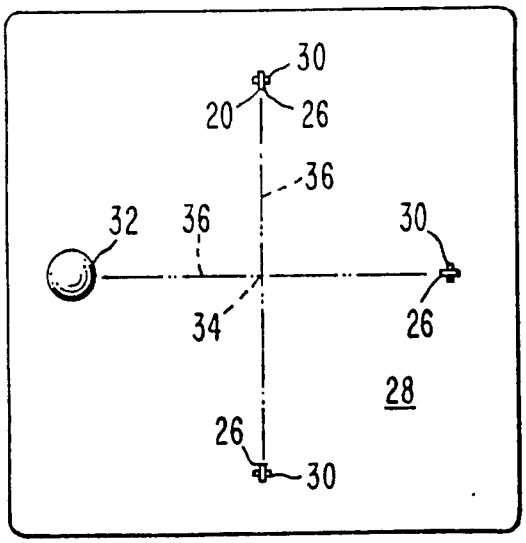
FIG. 2 is a bottom plan view of the embodiment shown in FIG. 1.

The cross member means will define a central axis 36 thereof which preferably is perpendicular with respect to the axis of the slot means 30. In the preferred configuration as shown in FIG. 2 this central axis of the cross member means 36 will each extend inwardly through the center point 34 of deflecting shield means 28. In this orientation the deflecting shield will be safely and securely held in suspension by the bracket means 20 in spaced relation with respect to dropped ceiling 12.

The deflecting shield means 28 will preferably be of a material similar to the ceiling configuration such that it will aesthetically blend therein. Normally such ceiling materials which normally are used also for the ceiling panel 16 would be of a thickness of approximately ½". For this reason the intervening spaces 44 defined between adjacent cross member means 26 will preferably be approximately 9/16" to facilitate placement of the deflecting shield 28 between the remaining lowermost cross member means and the next one immediately thereabove.

Figure 3:
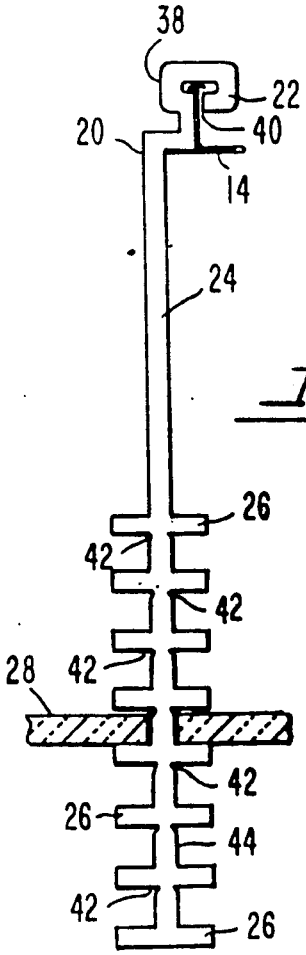
FIG. 3 is a side cross-sectional view showing the interlocking between an embodiment of the suspension bracket means of the present invention with respect to the inverted T-shaped ceiling support members.

The upper end of suspension bracket means 20 will preferably be formed as a loop member 38 which will include a cut section 40 in the lower portion thereof as best shown in the cross section of FIG. 3. This cut section will be adapted to receive a portion of the inverted T-shaped support member 14 therethrough. To facilitate this detachable securement when the suspension bracket 20 is of a resilient material such as plastic the installer will normally resiliently deform the loop member 38 thereby slightly increasing the open portion of cut section 40 allowing a portion of the inverted T-shaped support member 14 to extend therein. Once the inverted T-shaped support member is in place the installer can release the loop member 38 thereby allowing the cut section 40 to exert a bias against the inverted T-shaped support member to facilitate gripping thereof.

With this configuration the installer can choose to place the deflecting shield 28 between any two of the adjacent cross member means 26. Thus the distance can be varied greatly between the deflecting shield means 28 and the air outlet 10. This can allow for a more aesthetically pleasing final configuration or can allow for a more efficient placement of the deflecting shield 28. This can be left to the discretion of the installer who will have the best information available due to being on the spot at the time of installation.

Figure 7:
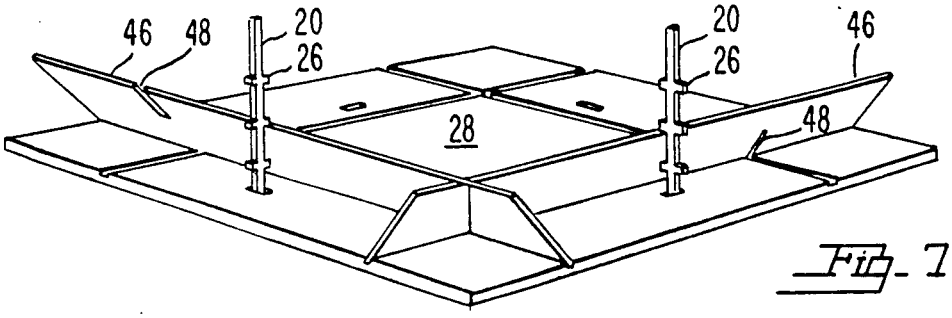
FIG. 7 is a perspective view of the embodiment of the present invention shown in FIG. 6.

The configuration shown in FIG. 7 is particularly usable when the air vent to which the present invention is to be utilized herewith is located adjacent to a wall or corner area. With such areas, as the air travels downwardly and contacts the deflecting shield as always approximately 25 percent of the air will travel over each of the four edges of the deflecting shield. The portions of the conditioned air which travel over deflecting shield 28 and exit over the edge adjacent to the wall will not be allowed to be dispersed outwardly and further due to the intervening wall area. The wall will tend to guide this air downwardly and will cause a downward draft to anyone located therebelow. For this reason vane means is utilized in the present invention comprising one or more vane members 46. These members are adapted to be angularly oriented with respect to the upper surface of deflecting shield 28 in such a manner as to guide air away from any wall area to which the present invention may be positioned adjacent.

The vane members 46 are angularly oriented with respect to the upper surface of the deflecting shield 28 preferably at an angle of approximately 60°. This angle can be determined by the angle of a groove means 50 which preferably is defined in the upper surface of the deflecting shield. This groove being oriented approximately 60° which is adapted to receive the vane means extending therein will thereby orient the vane automatically at approximately 60° with respect to the plane of the deflecting field.

Figure 4:
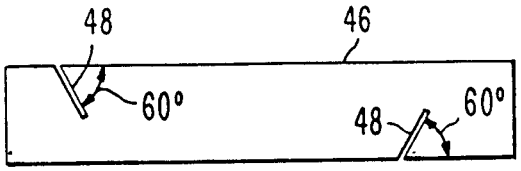
FIG. 4 is a side plan view of an embodiment of a vane of the present invention.
Figure 5:
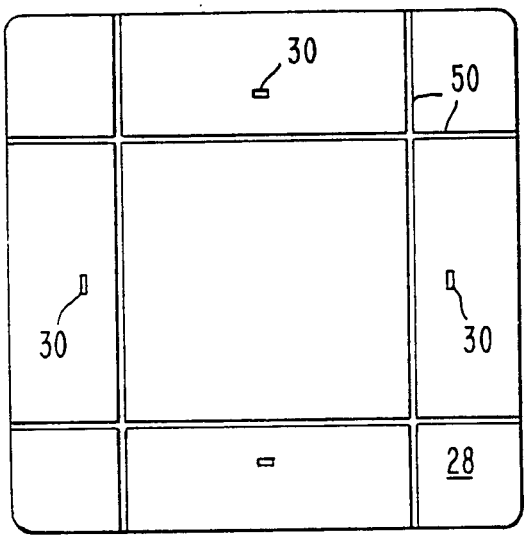
FIG. 5 is a top plan view of an embodiment of a deflecting shield of the present invention.
Figure 6:
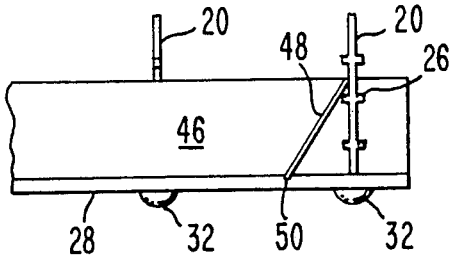
FIG. 6 is a side cross-sectional view of an embodiment of the present invention utilizing the embodiment of the deflecting shield shown in FIG. 3.

If the present invention is utilized in corner areas, this problem is more pronounced and as such the vane members preferably can be used in groupings of two as shown in FIGS. 6 and 7 more specifically. Vane members 46 may define a plurality of slit means 48 therein as shown in FIG. 4 such as to allow the individual vanes 46 to be engageable with respect to one another and positionable extending within perpendicularly oriented grooves defined in the deflecting shield 28. Also vane members 46 may be positioned with the upper edges thereof in abutment with respect to the suspension bracket for stabilization thereof.

With this configuration the present invention has a universal utility and can be used with a ceiling air duct regardless of its location. If the duct is located generally in the central area of a ceiling the conventional deflecting means of the present invention can be utilized. However if the air duct is positioned adjacent to a wall or corner structure the present invention can be used with one or more of the vane members 46 and in such a manner provide a means for dispersing of air emitted from an air vent regardless of the specific location of the air vent in the ceiling area of the room whether it be adjacent to walls, corners or centrally located.

It should be appreciated that the present invention, minus the vanes, could be hung from nearly any location in a dropped ceiling construction. In that context it could assume the application of a light duty suspended shelf fromtthe ceiling above. This shelf could support flowers, decorative things or other items. Also the suspension bracket could function as a hanger in virtually any location secured to a dropped ceiling construction in such a manner that any hanging items could be suspended therefrom.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. For use with air outlets defined in dropped ceiling constructions having a framework of inverted T-shaped support members with ceiling panels suspended therebetween, a means for deflecting air being emitted from the air outlets comprising:

( a) a plurality of suspension bracket means including:

(1) a hook means at the upper end of each of said suspension bracket means being selectively securable with respect to said inverted T-shaped support members;

(2) a rod means at the lower end of each of said suspension bracket means and extending downwardly from said hook means;

(3) a plurality of laterally extending cross-member means along said rod means positioned in spaced relation vertically with respect to one another;

(b) deflecting shield means detachably secured with respect to said suspension bracket means and extending generally horizontally therebetween and spaced downwardly from the ceiling panels and air outlets defined therein to deflect air exiting from the air outlets outwardly therefrom for dispersal thereof, said deflecting shield means defining a plurality of slot means therein adapted to receive said rod means extending therethrough; and (c) plurality of cover cap means positioned extending over the lower portions of said rod means and the lower of said cross-member means which extend below said deflecting shield means.

2. The means as defined in claim 1 further comprising a vane means to facilitate deflecting of air and wherein said deflecting shield means defines a groove means in the upper surface thereof, said groove means being adapted to receive said vane means extending therein for securement with respect to the upper surface of said deflecting shield means.

3. The means as defined in claim 2 wherein said groove means comprises a plurality of groove members, each defining slit means therein for detachable engagement with respect to one another.

4. The apparatus as defined in claim 3 wherein said groove means comprises at least two individual grooves being perpendicularly oriented with respect to one another to receive at least two of said vane means having said slits therein engaged with respect to one another.

5. The means as defined in claim 2 wherein said groove means is oriented at approximately 60° with respect to the plane of said deflecting shield means.

6. The air deflecting means as defined in claim 1 wherein said deflecting shield means is square.

7. The air deflecting means as defined in claim 1 wherein said deflecting shield means is rectangular.

8. The air deflecting means as defined in claim 1 wherein said deflecting shield means is made of similar material as the ceiling panels.

9. The air deflecting means as defined in claim 1 wherein said cover cap means are shaped hemispherically.

10. The air deflecting means as defined in claim 1 wherein said cover cap means are made of a material denser than the material of which said deflecting shield means is made.

11. The air deflecting means as defined in claim 1 wherein said suspension bracket means comprises four individual bracket members extending downwardly from the inverted T-shaped support members.

12. The air deflecting means as defined in claim 11 wherein said slot means defined in said deflecting shield means comprise four individual slot members oriented perpendicularly with respect to said cross-member means along said rod means extending through said slot members.

13. The air deflecting means as defined in claim 1 wherein said cross-member means are oriented perpendicularly with respect to said slot means defined in said deflecting shield means.

14. The air deflecting means as defined in claim 1 wherein the central axis of said cross-member means extends through the centerpoint of said deflecting shield means.

15. The air deflecting means as defined in claim 1 wherein said hook means comprises a loop member at the uppermost end of said suspension bracket means which defines a cut section therein adapted to receive a portion of the inverted T-shaped support member extending therethrough to facilitate gripping thereof by said suspension bracket means.

16. The air deflecting means as defined in claim 1 wherein said suspension bracket means is of flexibly resilient material.

17. The air deflecting means as defined in claim 1 wherein said suspension bracket means is of plastic.

18. The air deflecting means as defined in claim 1 wherein said rod means of said suspension bracket means is frangible at a position immediately below each of said cross-member means to facilitate severing thereof during installation.

19. The air deflecting means as defined in claim 1 wherein said cross-member means are spatially disposed with respect to one another at a distance greater than the thickness of said deflecting shield means.

20. The air deflecting means as defined in claim 1 wherein said deflecting shield means is approximately one-half inch in thickness.

21. The air deflecting means as defined in claim 20 wherein said cross-member means define intervening spaces therebetween of approximately nine-sixteenths of an inch.

22. For use with air outlets defined in dropped ceiling constructions having a framework of inverted T-shaped support members with ceiling panels suspended therebetween, a means for deflecting air being emitted from the air outlets comprising:

( a) four suspension bracket means made of flexibly resilient plastic, each bracket means including:

(1) a hook means at the upper end of each of said suspension bracket means being selectively securable with respect to said inverted T-shaped support members, said hook means including a loop member at the uppermost end of said suspension bracket means which defines a cut section therein adapted to receive a portion of said inverted T-shaped support member extending therethrough to facilitate gripping thereof by said suspension bracket means;

(2) a rod means at the lower end of each of said suspension bracket means and extending downwardly from said hook means;

(3) a plurality of laterally extending cross-member means along said rod means positioned in spaced relation vertically with respect to one another;

(4) a frangible section defined on each of said rod means immediately below each of said laterally extending cross-members to facilitate severing of said rod means at these locations during installation;

( b) an approximately square deflecting shield means detachably secured with respect to said suspension bracket means and extending horizontally therebetween and spaced downwardly from the ceiling panels and air outlets defined therein to deflect air exiting from the air outlets outwardly therefrom for dispersal thereof, said deflecting shield means being made of similar material as the ceiling panels, said deflecting shield means defining four slot means therein each being adapted to receive one of said rod means extending therethrough with said laterally extending cross-member means being perpendicularly oriented with respect to said slot means; and (c) a plurality of hemispherically-shaped cover cap means positioned extending over the lower portions of said rod means and the lower of said cross-member means which extend below said deflecting shield means and being in abutment therewith, said cover cap means being made of a material denser than the material of which said deflecting shield means is made.

* * * * *